US005088551A

United States Patent [19]

Brücher et al.

[11] Patent Number: 5,088,551

[45] Date of Patent: Feb. 18, 1992

[54] HEAT EXCHANGER FOR COOLING HOT REACTING GAS

[75] Inventors: Peter Brücher; Wolfgang Kehrer; Dieter Bormann, all of Berlin, Fed. Rep. of Germany

[73] Assignee: Deutsche Babcock-Borsig AG, Berlin, Fed. Rep. of Germany

[21] Appl. No.: 639,027

[22] Filed: Jan. 9, 1991

[30] Foreign Application Priority Data

Jan. 10, 1990 [DE] Fed. Rep. of Germany.....4000527

[51] Int. Cl.[5] ..... F28F 9/02

[52] U.S. Cl. ..... 165/134.1; 165/136; 165/158; 122/512

[58] Field of Search ..... 165/83, 158, 134.1, 165/136, 135; 122/512

[56] References Cited

U.S. PATENT DOCUMENTS

| | | | |
|---|---|---|---|
| 3,982,585 | 9/1976 | Gribsvad | 165/83 |
| 4,157,114 | 6/1979 | De Lorenzo | 165/158 |
| 4,170,263 | 10/1979 | Laber et al. | 165/158 |
| 4,202,406 | 5/1980 | Avery | 165/47 |
| 4,236,576 | 12/1980 | Deuse et al. | 165/134.1 |
| 4,336,770 | 6/1982 | Kaneko et al. | 122/266 |
| 4,488,513 | 12/1984 | Jahnke et al. | 122/32 |

*Primary Examiner*—Allen J. Flanigan
*Attorney, Agent, or Firm*—Max Fogiel

[57] ABSTRACT

A heat exchanger for cooling hot reaction gas with a coolant. It rests on a gas-supply compartment (4) and has gas-conveying pipes (9) inside a jacket (1). It is separated from the gas-supply compartment by a tube sheet (6) that accommodates the gas-conveying pipes (9). The pipes extend loosely through the tube sheet, leaving annular gaps (10), and are connected tightly to the tube sheet on the side where the gas enters. The heat exchanger has at least one line (12) for supplying coolant to the side of the tube sheet that faces away from where the gas enters. The diameter of the tube sheet is shorter than that of the jacket. The tube sheet is connected to the lower edge of the jacket by way of an upward-tapering cone (7). The tube sheet is provided with cooling channels (15) that are open at least at one end and communicate with the lines that supply the coolant.

8 Claims, 3 Drawing Sheets

HEAT EXCHANGER FOR COOLING HOT REACTING GAS

BACKGROUND OF THE INVENTION

A known heat exchanger (disclosed in German Patent 2 818 892) includes a base that consists of a thicker tube sheet that the gas-conveying pipes extend through loosely, leaving annular gaps, and of a thinner tube sheet that the gas-conveying pipes are welded into. The thinner tube sheet is secured at its outer circumference to the thicker tube sheet and rests on it by way of the gas-conveying pipes. The line that supplies the coolant empties between the two tube sheets and the coolant enters the heat exchanger through the annular gaps. Aside from the exploitation of the gas-conveying and hence pressurized pipes to secure the thinner tube sheet, the known heat exchanger entails the drawback that any particles suspended in the coolant, water, will precipitate on the inner surface of the thinner tube sheet, where it can cause overheating.

Also known (from Austrian Patent 361 953) is an upright heat exchanger with a sheaf of pipes secured in two tube sheets. The upper tube sheet, the tube sheet at the outgoing-gas end, is provided with cooling channels that communicate with the inside of the heat exchanger through the gaps around the gas-conveying pipes.

The object of the present invention is to improve the generic heat exchanger to the extent that the tube sheet at the gas-end has thinner walls and that the coolant will flow through it without leaving deposits of solid particles on its coolant-end surface.

The tube sheet in the heat exchanger in accordance with the present invention can in general be thick enough to withstand the high pressure exerted by the coolant. The cooling channels that extend through the tube sheet can be distributed to allow the walls between the heat-emitting reaction gas and the pressurized and heat-absorbing coolant, boiling water, to remain thin. The coolant will flow rapidly enough through the cooling channels to prevent any suspended solid particles from depositing on the coolant side of the tube sheet and to rinse them away. Since the tube sheet is above the lower edge of the jacket, the solid particles will be able to accumulate below the tube sheet, at the lowest point of the heat exchanger. This lowest point can, in one version of the invention, remain unheated. If the supply of coolant is interrupted and the flow of gas turned off, enough coolant will flow through the channels that are exposed to the jacket to initiate emergency cooling and remove the residual heat.

The alternating obstruction of the ends of the channels will produce mutually opposed coolant flows in the adjacent channels. The result will be a rotary current in the annular gaps around the gas-conveying pipes that will thoroughly cool that vicinity.

BRIEF DESCRIPTION OF THE DRAWINGS

Several embodiments of the invention will now be specified with reference to the drawing, wherein.

DESCRIPTION OF THE PREFERRED EMBODIMENTS

Figure 1:
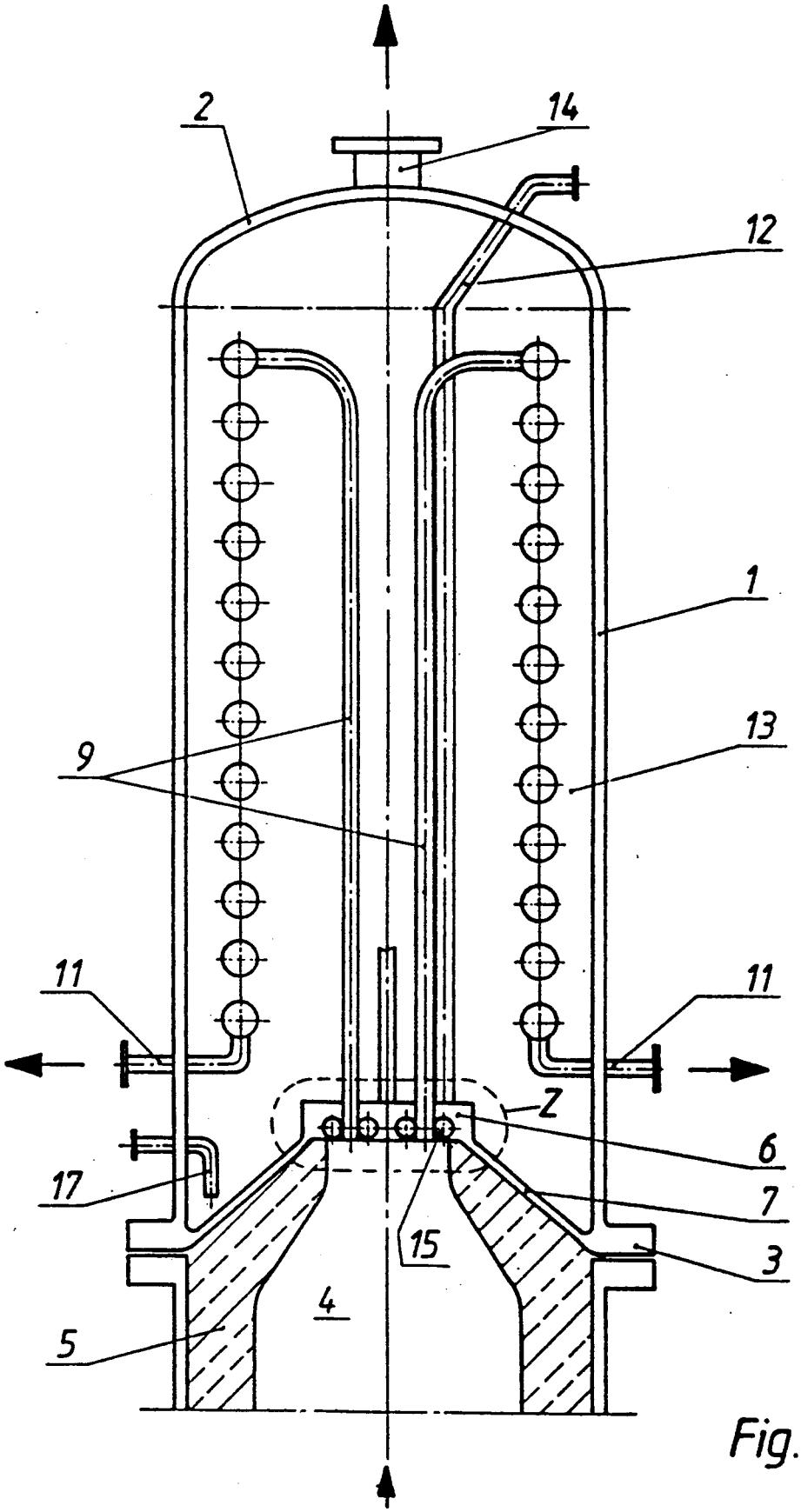
FIG. 1 is a schematic longitudinal section through a heat exchanger.

The heat exchanger is an upright model and consists of a jacket 1 topped by a dome 2 and with a flange 3 around its lower edge. It rests on a gas-supply compartment 4 that has a refractory lining 5. Communicating with gas-supply compartment 4 is an unillustrated pressurized reactor, which can be part of an oil-gasification plant.

The jacket 1 of the heat exchanger is separated from gas-supply compartment 4 by a tube sheet 6 with a diameter shorter than that of jacket 1. Tube sheet 6 is secured to the flange 3 around the lower edge of jacket 1 by way of an upward-tapering cone 7 such that the tube sheet is positioned above the flange. Cone 7 has a refractory lining 5 like that of gas-supply compartment 4.

Gas-conveying pipes 9 extend through bores 8 in tube sheet 6, which parallel the longitudinal axis of the heat exchanger, loosely enough to leave an annular gap 10. The intake ends of pipes 9 are welded tight into tube sheet 6 at the side that the gas arriving from gas-supply compartment 4 flows against.

Pipes 9 extend straight up above tube sheet 6 to the vicinity of dome 2. In this vicinity every pipe 9 coils into a spiral with its outlet communicating with a connector 11 that extends through jacket 1 just above tube sheet 6.

The gas from gas-supply compartment 4 flows through pipes 9 and is simultaneously cooled by a coolant supplied as will be described hereinafter through several lines 12 to the inside 13 of the heat exchanger, which is demarcated by jacket 1. The coolant is compressed water, which evaporates when it absorbs heat from the gas and leaves the heat exchanger in the form of steam by way of an outlet 14 in flange 3.

The half of tube sheet 6 that faces the incoming gas has parallel cooling channels 15 that open into the inside 13 of the heat exchanger. Cooling channels 15 are wide enough to touch bores 8. One end of cooling channels 15 is preferably closed off by a cover 16 secured to the outer surface of tube sheet 6. Adjacent cooling channels 15 can be closed off at opposite ends.

Figure 2:
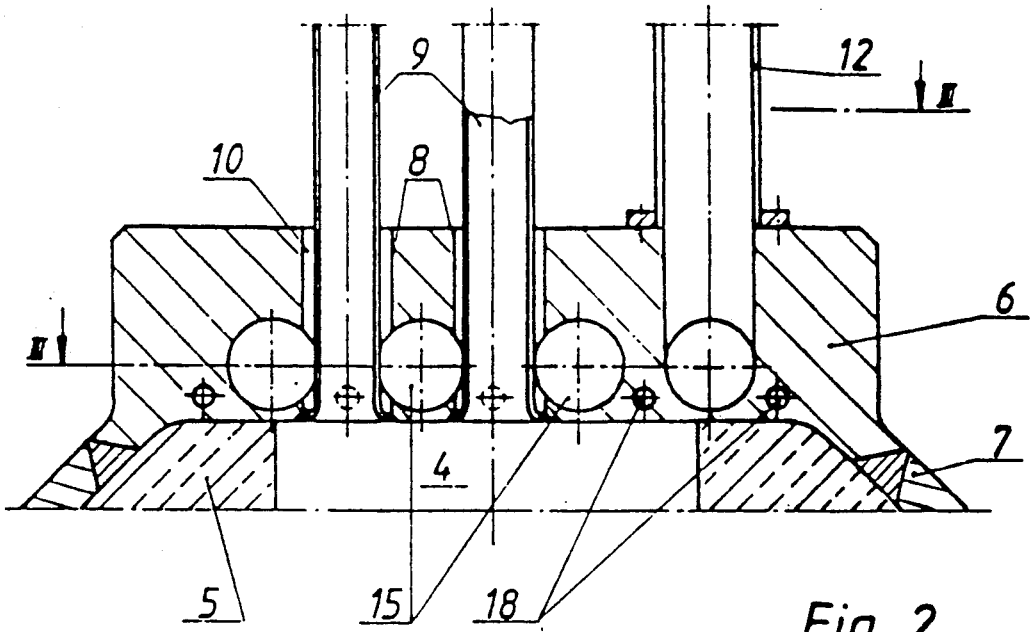
FIG. 2 is a detail of the area Z in FIG. 1.
Figure 3:
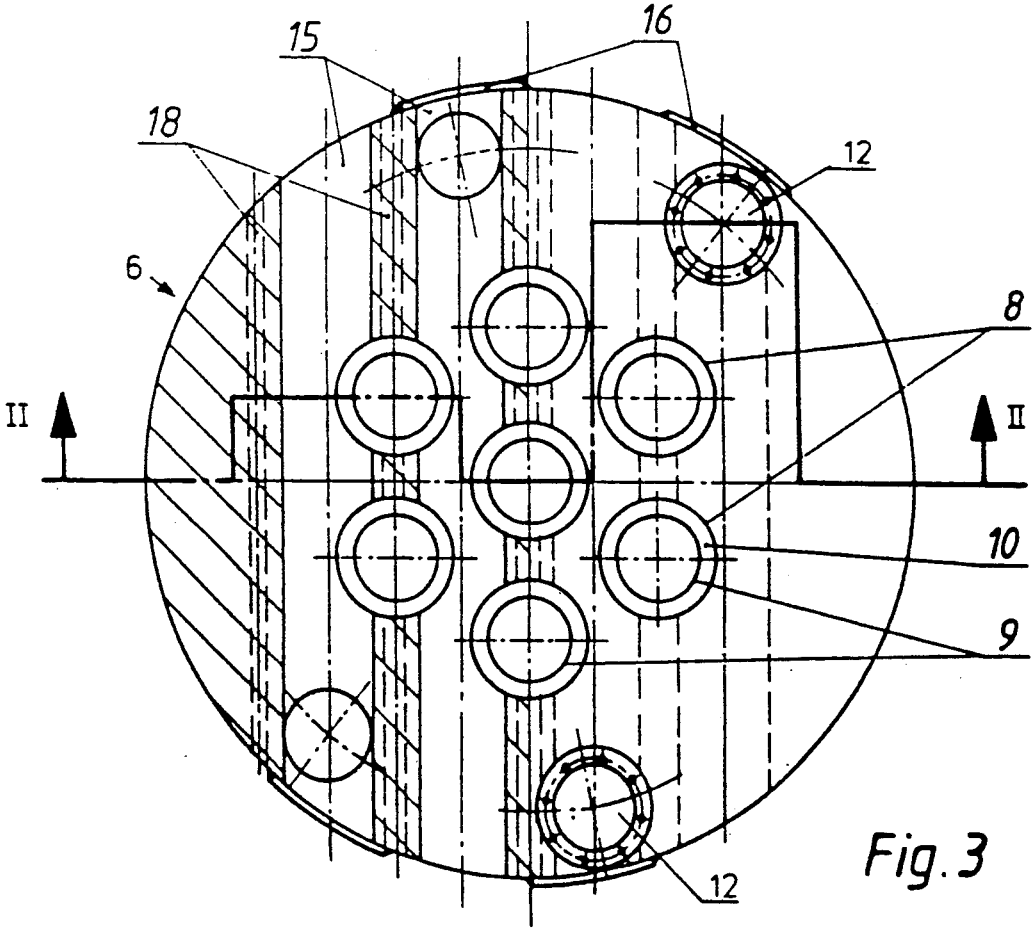
FIG. 3 is a section along the line III—III in FIG. 2.

Associated with the closed-off end of every cooling channel 15 is one of the coolant-supply lines 12. The line 12 illustrated in FIG. 2 extends down through tube sheet 6 into its associated cooling channel 15. The coolant can also be supplied to the channels from the side. If adjacent channels are closed off at opposite ends the coolant will flow through them in opposite directions. The coolant will penetrate into gaps 10 and initiate a rotary flow around pipe 9, cooling the hot area more thoroughly.

The water arriving through lines 12 enters cooling channels 15, flows through them, rises to some extent through annular gaps 10, and arrives in the inside 13 of the heat exchanger. The rest of the coolant flows through the open ends of cooling channels 15 and into inside 13 directly. Any solid particles that remain suspended in the coolant in spite of careful preparation will be rinsed along with the coolant out of channels 15 and will accumulate at the lowest point of the heat exchanger. This point is below tube sheet 6 in the annular space between cone 7 and jacket 1. This zone is unheated because the surface facing the gas has its refractory lining 5. Opening into the annular space is a vacuum line 17 that can be used to remove precipitated solid particles from the heat exchanger.

Tube sheet 6 has provisions for emergency cooling in the event that the supply of coolant is interrupted followed by discontinuation of the supply of gas. In this situation the residual heat must be eliminated, which is done by pumping coolant out of inside 13 through cooling channels 15. This current of coolant will cool tube sheet 6.

To also allow cooling of those components of tube sheet 6 between cooling channels 15, cooling bores 18 that are open at each end can extend parallel to and on each side of each channel 15 through tube sheet 6 in the vicinity of the surface subjected to the gas. Cooling bores 18 are narrower than cooling channels 15. The interior cooling bores 18 open into annular gaps 10.

Figure 4:
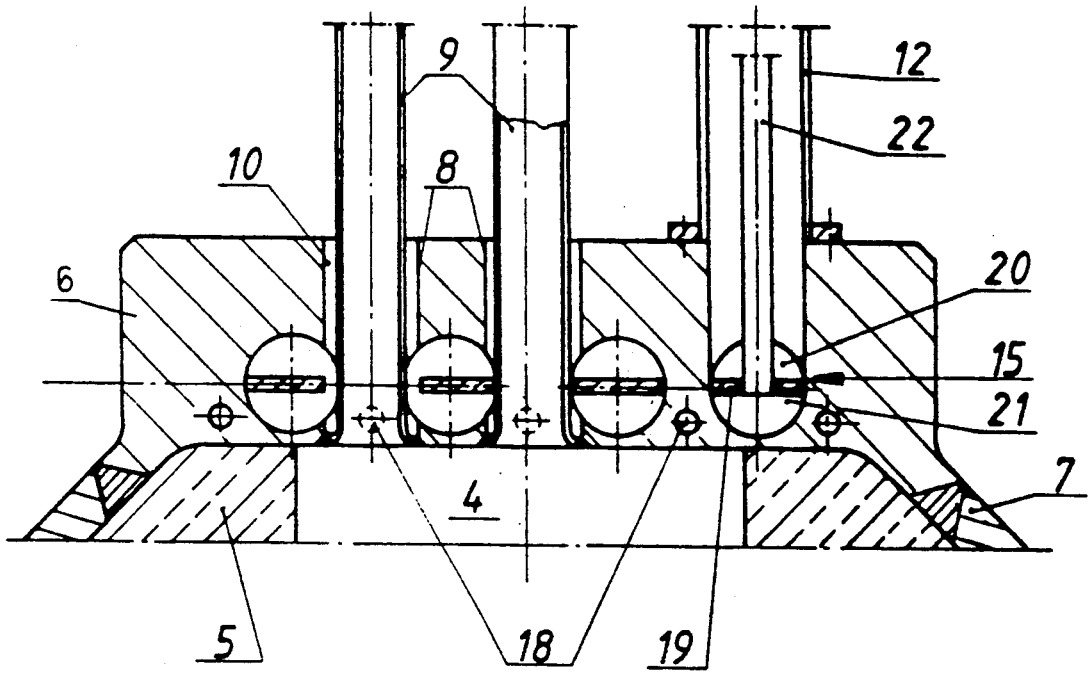
FIG. 4 is a detail of another version of the area Z in FIG. 1.

Cooling channels 15 can also, as illustrated in FIG. 4, be vertically separated into two subsidiary channels 20 and 21 by a partition 19. If line 12 is double, each subsidiary canal can have its own coolant-supply connection, with an inner pipe 20 conveying a colder coolant, fresh water for example, into lower subsidiary canal 20 while upper subsidiary canal 21 is supplied with a warmer coolant, recirculated water for example, from the annular space between inner pipe 22 and line 12.

We claim:

1. A heat exchanger for cooling hot reaction gas with a coolant, comprising: a gas supply chamber; a jacket around said heat exchanger and having a diameter; a tube sheet with a first side and a second side separating said jacket from said gas supply chamber; a plurality of gas-conveying pipes with a central portion and extending loosely through said tube sheet second side and leaving annular gaps between said gas-conveying pipes and said tube sheet second side; said gas-conveying pipes being connected tightly to said tube sheet on said first side, gas entering said pipes from said supply chamber at said first side; at least one pipe line for supplying coolant to said second side of said tube sheet, said second side facing opposite said first side; said tube sheet having a diameter smaller than the diameter of said jacket; a cone tapering inwardly in direction of the central portion of said gas-conveying pipes and connecting said tube sheet to a lower edge of said jacket; a source of coolant supply; said tube sheet having cooling channels with at least one open end and communicating with said source of coolant supply.

2. A heat exchanger as defined in claim 1, wherein said cone has a substantially uniform thickness.

3. A heat exchanger as defined in claim 1, wherein said at least one pipeline for supplying coolant comprises a plurality of pipelines with one of said supply lines terminating at a closed end of every cooling channel, adjacent cooling channels being closed at opposite ends, said cooling channels contacting bores through said tube sheet.

4. A heat exchanger as defined in claim 1, including a refractory lining on a surface of said cone, reaction gas flowing along said refractory lining on said surface of said cone.

5. A heat exchanger as defined in claim 1, wherein said tube sheet has cooling bores extending through said tube sheet and being open at each end, said cooling bores being parallel to said cooling channels.

6. A heat exchanger as defined in claim 5, wherein said cooling channels and said cooling bores are located in a half of said tube sheet adjacent said first side.

7. A heat exchanger as defined in claim 1, including a partition separating said cooling channels vertically into two subsidiary channels, each subsidiary channel having its own coolant flowing therethrough.

8. A heat exchanger as defined in claim 1, wherein said gas conveying pipes extend straight upward, and thereafter coil down into outlets adjacent said tube sheet.

* * * * *